US006166490A

United States Patent [19]

Hansen

[11] Patent Number: 6,166,490

[45] Date of Patent: Dec. 26, 2000

[54] FIELD EMISSION DISPLAY OF UNIFORM BRIGHTNESS INDEPENDENT OF COLUMN TRACE-INDUCED SIGNAL DETERIORATION

[75] Inventor: Ronald L. Hansen, San Jose, Calif.

[73] Assignee: Candescent Technologies Corporation, San Jose, Calif.

[21] Appl. No.: 09/318,591

[22] Filed: May 25, 1999

[51] Int. Cl.[7] ..... G09G 3/10

[52] U.S. Cl. ..... 315/169.1; 315/169.3

[58] Field of Search ..... 315/169.1, 169.3, 315/349, 169.4, 350, 366; 345/74

[56] References Cited

U.S. PATENT DOCUMENTS

| | | | |
|---|---|---|---|
| 5,210,472 | 5/1993 | Casper et al. | 315/349 |
| 5,410,218 | 4/1995 | Hush | 315/169.1 |
| 5,638,085 | 6/1997 | Hush et al. | 345/74 |
| 5,847,515 | 12/1998 | Lee et al. | 315/169.1 |
| 5,856,812 | 1/1999 | Hush et al. | 345/74 |
| 5,909,201 | 6/1999 | Hush et al. | 345/74 |
| 5,952,987 | 9/1999 | Browning et al. | 345/74 |
| 6,034,479 | 3/2000 | Xia | 315/169.1 |

*Primary Examiner*—Don Wong
*Assistant Examiner*—Chuc Tran
*Attorney, Agent, or Firm*—Wagner, Murabito & Hao LLP

[57] ABSTRACT

A field emission display of uniform brightness across the entire display screen. The field emission display according to the present invention includes row lines, column lines, and electron-emissive elements disposed at intersections of the row lines and column lines. The field emission display according to the present invention further includes row drivers coupled to selectively activate the row lines one row at a time and column drivers coupled to drive column voltages over the column lines. According to the present invention, the column voltages are derived from gray-scale data and a compensating voltage signal that represents a row position of the currently activated row line. In one embodiment of the present invention, the farther the currently activated row line is away from the driven ends of the column lines, the higher is the compensating voltage. Consequently, visual artifacts, specifically those caused by degradation of signals along the column lines attributed to transmission line effects, are significantly reduced or eliminated.

22 Claims, 11 Drawing Sheets

FIELD EMISSION DISPLAY OF UNIFORM BRIGHTNESS INDEPENDENT OF COLUMN TRACE-INDUCED SIGNAL DETERIORATION

FIELD OF THE INVENTION

The present invention relates generally to the field of display systems. More specifically, the present invention relates to Field Emission Displays (FEDs).

BACKGROUND OF THE INVENTION

Flat panel field emission displays (FEDs), like standard cathode ray tube (CRT) displays, generate light by impinging high energy electrons on a picture element (pixel) of a phosphor screen. The excited phosphor then converts the electron energy into visible light. However, unlike conventional CRT displays which use a single or in some cases three electron beams to scan across the phosphor screen in a raster pattern, FEDs use stationary electron beams for each color element of each pixel. This allows the distance from the electron source to the screen to be very small compared to the distance required for the scanning electron beams of the conventional CRTs. In addition, the vacuum tube of the FED can be made of glass much thinner than that of conventional CRTs. Moreover, FEDs consume far less power than CRTs. These factors make FEDs ideal for portable electronic products such as laptop computers, pocket-TVs and portable electronic games.

As mentioned, FEDs and conventional CRT displays differ in the way the image is produced. Conventional CRT displays generate images by scanning an electron beam across the phosphor screen in a raster pattern. As the electron beam scans along the row (horizontal) direction, its intensity is adjusted according to the desired brightness of each pixel of the row. After a row of pixel is scanned, the electron beam steps down and scans the next row with its intensity modulated according to the desired brightness of that row. In contrast, FEDs generate images according to a "matrix" addressing scheme. Each electron beam of the FED is formed at the intersection of individual rows and columns of the display. Rows are updated sequentially. A single row electrode is activated with all the columns active, and the voltage applied to each column determines the magnitude of the electron beam formed at the intersection of that row and column. Then, the next row is subsequently activated and new brightness information is set again on each of the columns. When all the rows have been thus updated, a new frame has been displayed.

When the columns of a FED are driven with rapidly changing voltage levels, they can be viewed as electrically equivalent to transmission lines. This is due to the fact that a column line is itself a network of distributed resistance and capacitance. Thus, as a signal is propagated down the column line, the signal may degrade and the voltage potential of the signal may drop, making the driven end slightly brighter than the non-driven end of the column line. In a single-end driven display where column drivers are disposed across the top portion of the display, the resultant effect can be a gradual reduction in brightness from the top to bottom of the display. In an interdigitated display where interleaving column lines are driven on opposite ends of the display (e.g., top, bottom, top, bottom, etc.), the resultant effect can be a "comb-like" pattern (or, alternating bright and dark bands) along the top and bottom edges of the display. Although these visual artifacts are hardly noticeable in small and low resolution displays, they can be glaring in larger and higher resolution displays.

One method of eliminating such "transmission line" effects is by varying the resistance of the column traces along their length. For example, the width of the column traces can be made to be wider (thus less resistive per unit length) at the far end and narrower (thus more resistive per unit length) at the driven end. That method, however, is disadvantageous because column traces with a "tapered" width are difficult and expensive to manufacture.

Therefore, what is needed is a field emission display that does not exhibit brightness degradation along the column lines. What is further needed is a system and method for eliminating visual artifacts caused by signal deterioration along the column traces due to transmission line effects. What is yet further needed is a system and method for eliminating such visual artifacts without compromising the gray-scale resolution of the display.

SUMMARY OF THE DISCLOSURE

Accordingly, a field emission display of uniform brightness independent of column trace-induced signal deterioration is disclosed. The field emission display according to the present invention includes row lines, column lines, and electron-emissive elements disposed at intersections of the row lines and column lines. The field emission display according to the present invention further includes row drivers coupled to selectively activate the row lines one row at a time and column drivers coupled to drive column voltages over the column lines. According to the present invention, the column voltages are derived from gray-scale data and a compensating voltage signal that is based on a row position of the currently activated row line. In one embodiment of the present invention, the farther the currently activated row line is away from the driven ends of the column lines, the higher is the compensating voltage. In this way, visual artifacts that are caused by degradation of signals along the column lines due to transmission line effects, are significantly reduced or eliminated.

According to one embodiment of the present invention, the field emission display includes interleaving column lines driven by column drivers located at opposite ends of the display. According to the present embodiment, one group of column lines are driven by column voltages derived from gray-scale data and a first compensating voltage while another group of column lines are driven by column voltages derived from gray-scale data and a second compensating voltage. The first compensating voltage and the second compensating voltage are both representative of the row number of the currently activated row line. However, the first compensating voltage and the second compensating voltage are complementary of each other. In one particularly embodiment, the first compensating voltage signal is a periodic waveform having a positive ramp, and the second compensating voltage signal is another periodic waveform having a negative ramp.

In accordance with the present invention, the compensating voltage can be generated using several different methods. In one embodiment, the field emission display includes a counter that is clocked by a HSYNC signal (generated by a controller circuit) of the field emission display. The output of the counter thus represents the row number of the currently activated row line. The output of the counter is then transformed into the respective compensating voltages by digital-to-analog (D/A) converters. The counter may also be reset periodically by a VSYNC signal generated by the controller circuit. In another embodiment, the field emission display may include a constant current source coupled to charge a capacitor, and a switch coupled to discharge the capacitor in synchronism with the VSYNC signal.

More specifically, embodiments of the present invention include the above and further include an electronic system for controlling a field emission display comprising: row drivers coupled to selectively activate row lines of the field emission display one row at a time; a first group of column drivers coupled to drive first column voltages over the first group of column lines of the display; a first compensating voltage circuit coupled to the first group of column drivers; a second group of column drivers coupled to drive second column voltages over the second group of column lines of the display, wherein the first compensation circuit and the second compensation circuit are configured for providing a first compensating voltage and a second compensating voltage for variably biasing the first group and second group of column drivers, respectively.

BRIEF DESCRIPTION OF THE DRAWINGS

The accompanying drawings, which are incorporated in and form a part of this specification, illustrate embodiments of the present invention and, together with the description, serve to explain the principles of the invention.

DETAILED DESCRIPTION OF THE PREFERRED EMBODIMENTS

Reference will now be made in detail to the present embodiments of the invention, examples of which are illustrated in the accompanying drawings. While the invention will be described in conjunction with the present embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following description, for purposes of explanation, numerous specific details are set forth in order to provide a thorough understanding of the present invention. It will be apparent, however, to one skilled in the art, upon reading this disclosure, that the present invention may be practiced without these specific details. In other instances, well-known structures and devices are not described in detail in order to avoid obscuring aspects of the present invention.

Figure 1:
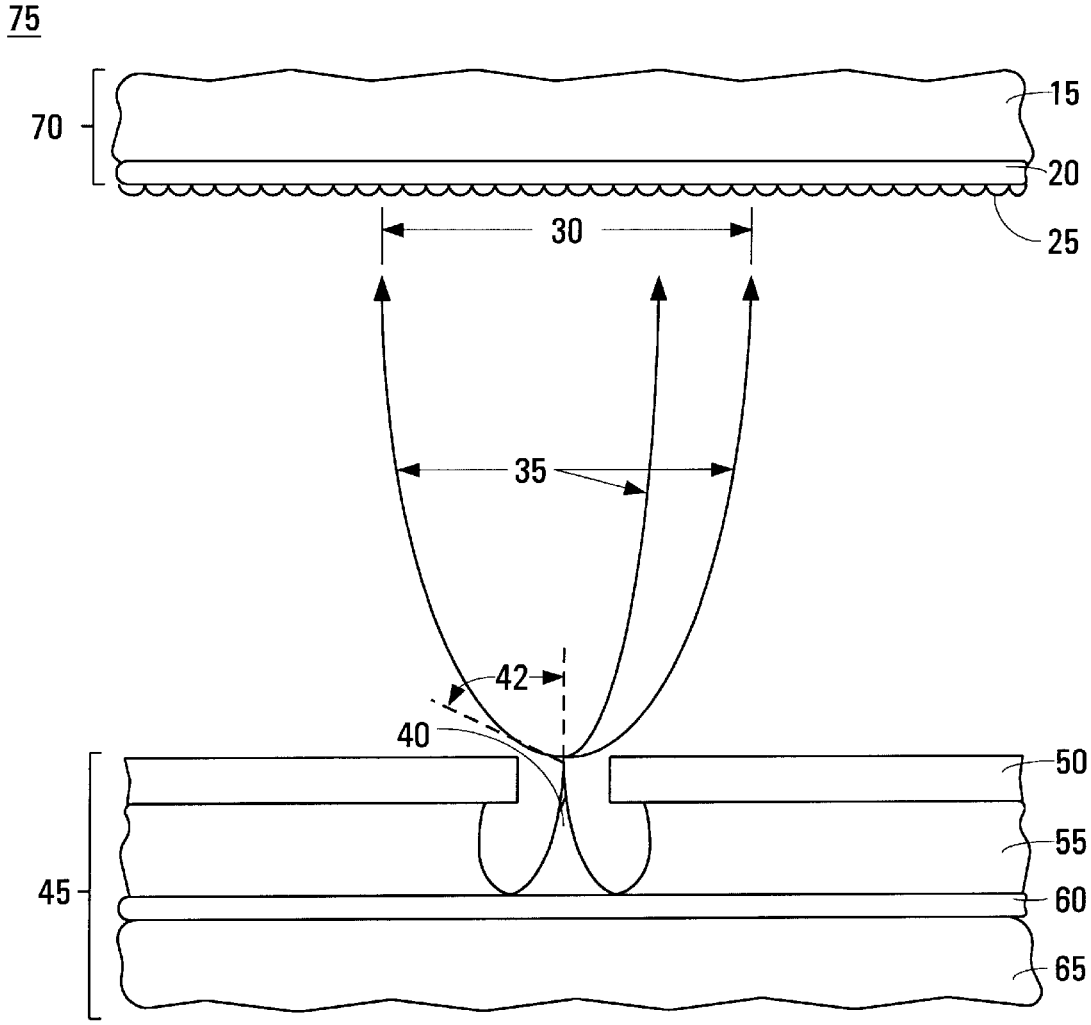
FIG. 1 is a cross section structural view of part of a flat panel FED screen that utilizes a gated field emitter situated at the intersection of a row and a column line.

A discussion of an emitter of a field emission display is presented. FIG. 1 illustrates a multi-layer structure 75 which is a portion of an FED flat panel display. The multi-layer structure 75 contains a field-emission backplate structure 45, also called a baseplate structure, and an electron-receiving faceplate structure 70. An image is generated by faceplate structure 70. Backplate structure 45 commonly consists of an electrically insulating backplate 65, an emitter (or cathode) electrode 60, an electrically insulating layer 55, a patterned gate electrode 50, and a conical electron-emissive element 40 situated in an aperture through insulating layer 55. One type of electron-emissive element 40 is described in U.S. Pat. No. 5,608,283, issued on Mar. 4, 1997 to Twichell et al. and another type is described in U.S. Pat. No 5,607,335, issued on Mar. 4, 1997 to Spindt et al., which are both incorporated herein by reference. The tip of the electron-emissive element 40 is exposed through a corresponding opening in gate electrode 50. Emitter electrode 60 and electron-emissive element 40 together constitute a cathode of the illustrated portion 75 of the FED flat panel display. Faceplate structure 70 is formed with an electrically insulating faceplate 15, an anode 20, and a coating of phosphors 25. Electrons emitted from element 40 are received by phosphors portion 30.

Anode 20 of FIG. 1 is maintained at a positive voltage relative to cathode 60/40. The anode voltage is 100–300 volts for spacing of 100–200 um between structures 45 and 70 but in other embodiments with greater spacing the anode voltage is in the kilovolt range. Because anode 20 is in contact with phosphors 25, the anode voltage is also impressed on phosphors 25. When a suitable gate voltage is applied to gate electrode 50, electrons are emitted from electron-emissive element 40 at various values of off-normal emission angle theta 42. The emitted electrons follow non-linear (e.g., parabolic) trajectories indicated by lines 35 in FIG. 1 and impact on a target portion 30 of the phosphors 25. The phosphors struck by the emitted electrons produce light of a selected color and represent a phosphor spot. A single phosphor spot can be illuminated by thousands of emitters.

Phosphors 25 are part of a picture element ("pixel") that contains other phosphors (not shown) which emit light of different color than that produced by phosphors 25. Typically a pixel contains three phosphor spots, a red spot, a green spot and a blue spot. Also, the pixel containing phosphors 25 adjoins one or more other pixels (not shown) in the FED flat panel display. The pixels of an FED flat panel screen are arranged in a matrix form including columns and rows. In one implementation, a pixel is composed of three phosphor spots aligned in the same row, but having three separate columns. Therefore, a single pixel is uniquely identified by one row and three separate columns (a red column, a green column and a blue column).

The size of target phosphor portion 30 of FIG. 1 depends on the applied voltages and geometric and dimensional characteristics of the FED flat panel display 75. Increasing the anode/phosphor voltage to 1,500 to 10,000 volts in the FED flat panel display 75 of FIG. 1 requires that the spacing between the backplate structure 45 and the faceplate structure 70 be much greater than 100–200 um. Increasing the interstructure spacing to the value needed for a phosphor potential of 1,500 to 10,000 volts causes a larger phosphor portion 30, unless electron focusing elements are added to the FED flat panel display of FIG. 1. Such focusing elements can be included within FED flat panel display structure 75 and are described in U.S. Pat. No. 5,528,103 issued on Jun. 18, 1996 to Spindt, et al., which is incorporated herein by reference.

Importantly, the brightness of the target phosphor portion 30 depends on the voltage potential applied across the cathode 60/40 and the gate 50. The larger the voltage potential, the brighter the target phosphor portion 30. Secondly, the brightness of the target phosphor portion 30 depends on the amount of time a voltage is applied across the cathode 40/60 and the gate 50 (e.g., on-time window). The larger the on-time window, the brighter the target phosphor portion 30. Therefore, within the present invention, the brightness of FED flat panel structure 75 is dependent on the voltage and the amount of time (e.g., "on-time") the voltage is applied across cathode 60/40 and the gate 50.

Figure 2:
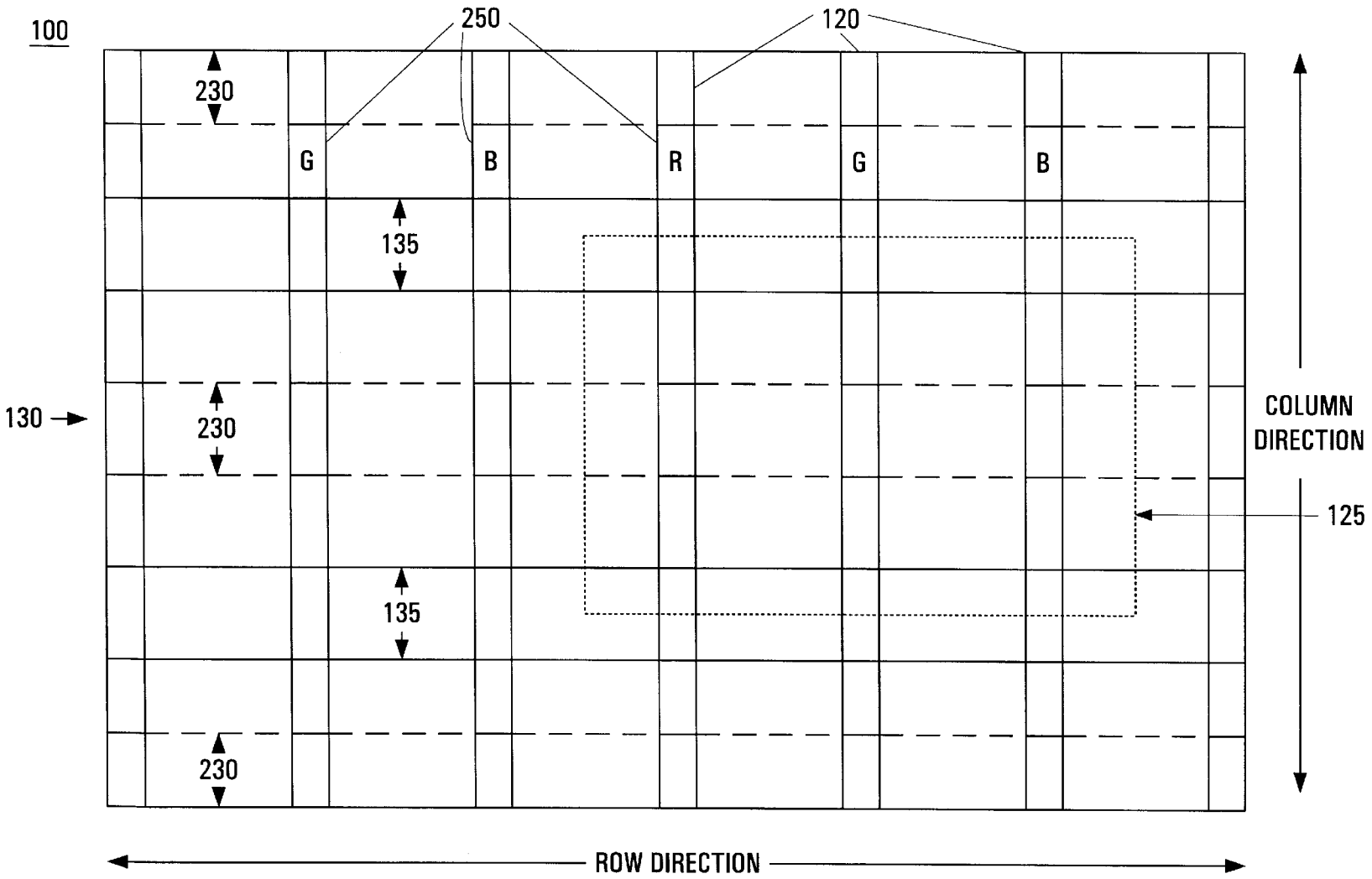
FIG. 2 is a plan view of internal portions of the flat panel FED screen of the present invention and illustrates several intersecting rows and columns of the display.

The FED flat panel display is subdivided into an array of horizontally aligned rows and vertically aligned columns of pixels. A portion 100 of this array is shown in FIG. 2. The boundaries of a respective pixel 125 are indicated by dashed lines. Three separate emitter lines 230 are shown. Each row line 230 is a row electrode for one of the rows of pixels in the array. In one embodiment, the each row line 230 is coupled to the emitter cathodes 60/40 (FIG. 1) of each emitter of the particular row associated with the electrode. A portion of one pixel row is indicated in FIG. 2 and is situated between a pair of adjacent spacer walls 135. A pixel row is comprised of all of the pixels along one row line 230. Two or more pixels rows (and as much as 24–100 pixel rows), are generally located between each pair of adjacent spacer walls 135. In one pixel format, each column has three column lines 250: (1) one for red; (2) a second for green; and (3) a third for blue. Likewise, each pixel column includes one of each phosphor stripes (red, green, blue), three stripes total. In the present embodiment, each of the column lines 250 is coupled to the gate 50 (FIG. 1) of each emitter structure of the associated column. This structure 100 is described in more detail in U.S. Pat. No. 5,477,105 issued on Dec. 19, 1995 to Curtin, et al., which is incorporated herein by reference. It should be appreciated that, in other FED designs, the column lines may be coupled to the emitter cathodes and the row lines may be coupled to the gate electrodes. It should also be appreciated that other pixel formats, such as quad-pixel format, may be used as well.

The red, green and blue phosphor stripes 25 (FIG. 1) are maintained at a positive voltage of 1,500 to 10,000 volts relative to the voltage of the emitter-cathode 60/40. When one of the sets of electron-emission elements 40 is suitably excited by adjusting the voltage of the corresponding row lines 230 and column lines 250, elements 40 in that set emit electrons which are accelerated toward a target portion 30 of the phosphors in the corresponding color. The excited phosphors then emit light. During a screen frame refresh cycle (performed at a rate of approximately 60 Hz in one embodiment), only one row is active at a time and the column lines are energized to illuminate the one row of pixels for the on-time period. This is performed sequentially in time, row by row, until all pixel rows have been illuminated to display the frame. Frames are presented at 60 Hz. Assuming n rows of the display array, each row is energized at a rate of 16.7/n ms. The above FED configuration is described in more detail in the following U.S. Pat. No. 5,541,473 issued on Jul. 30, 1996 to Duboc, Jr. et al.; U.S. Pat. No. 5,559,389 issued on Sep. 24, 1996 to Spindt et al.; U.S. Pat. No. 5,564,959 issued on Oct. 15, 1996 to Spindt et al.; and U.S. Pat. No. 5,578,899 issued Nov. 26, 1996 to Haven et al., which are incorporated herein by reference.

Figure 3:
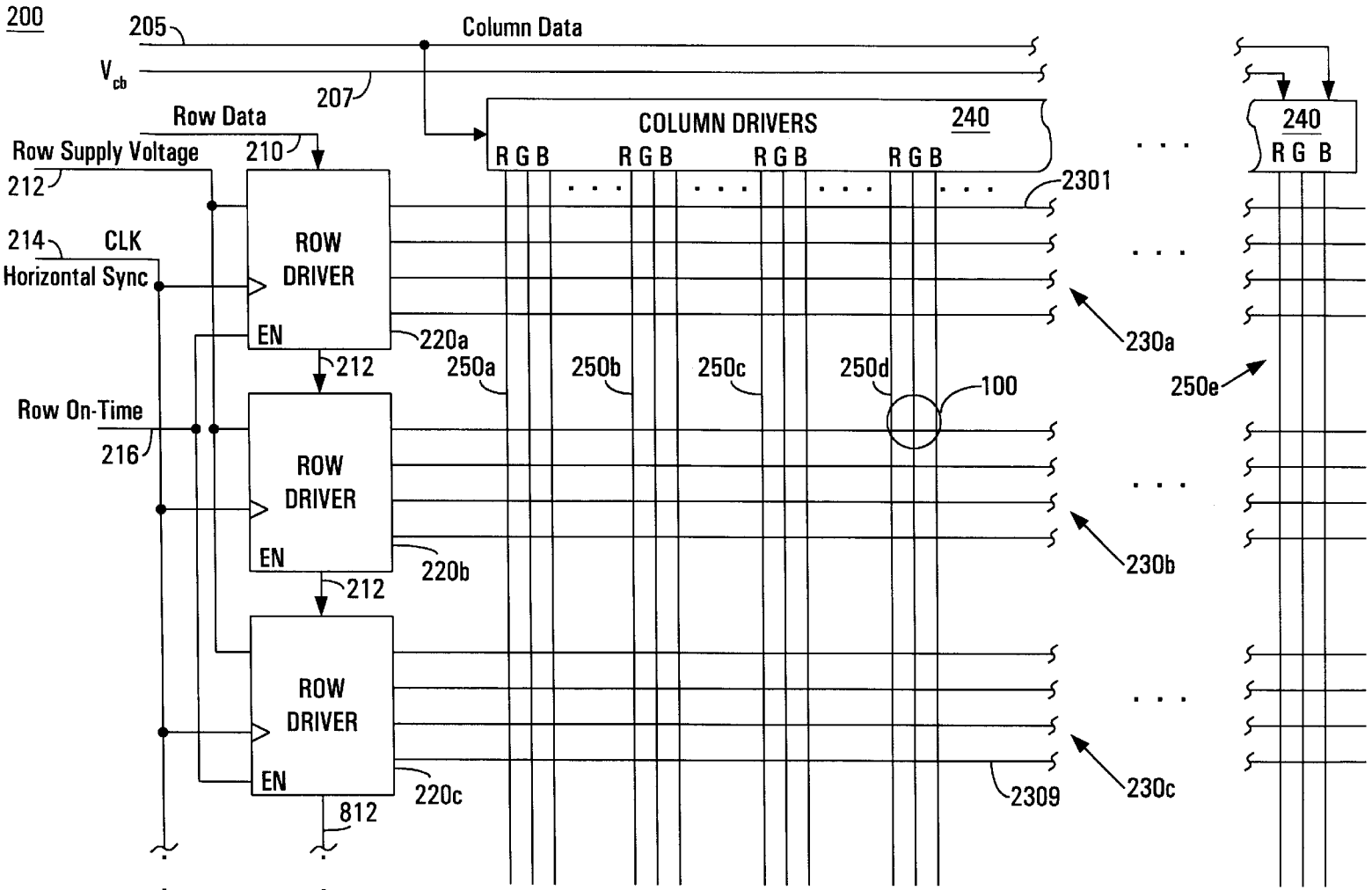
FIG. 3 illustrates a plan view of an flat panel FED screen in accordance with a non-interdigitated embodiment of the present invention illustrating row and column drivers and numerous intersecting rows and columns.

FIG. 3 illustrates an FED flat panel display 200 in accordance with one embodiment of the present invention. Region 100, as described with respect to FIG. 2, is also shown in FIG. 3. The FED flat panel display 200 consists of n row lines (horizontal) and x column lines (vertical). For clarity, a row line is called a "row" and a column line is called a "column." Row lines are driven by row driver circuits 220*a*–220*c*. Shown in FIG. 3 are row groups 230*a*, 230*b* and 230*c*. Each row group is associated with a particular row driver circuit; three row driver circuits are shown 220*a*–220*c*. In one embodiment of the present invention there are over 400 rows and approximately 5–10 row driver circuits. However, it is appreciated that the present invention is equally well suited to an FED flat panel display screen having any number of rows. Also shown in FIG. 3 are column groups 250*a*, 250*b*, 250*c* and 250*d*. In one embodiment of the present invention there are over 1920 columns for providing at least 640 pixel resolution horizontally. However, it is appreciated that the present invention is equally suited for an FED flat panel display screen having any number of columns and pixel formats.

Row driver circuits 220*a*–220*c* are placed along the periphery of the FED flat panel display screen 200. In FIG. 3, only three row drivers are shown for clarity. Each row driver 220*a*–220*c* is responsible for driving a group of rows. For instance, row driver 220*a* drives rows 230*a*, row driver 220*b* drives rows 230*b* and row driver 220*c* drives rows 230*c*. Although an individual row driver is responsible for driving a group of rows, only one row is active at a time across the entire FED flat panel display screen 200. Therefore, an individual row driver drives at most one row line at a time, and when the active row line is not in its group during a refresh cycle it is inactive. Further, when a row is inactive, the corresponding row driver provides a "resting," or "row-off" voltage over the row. A supply voltage line 212 is coupled in parallel to all row drivers 220*a*–220*c* and supplies the row drivers 220*a*–*c* with row driving voltages.

In furtherance of the embodiments illustrated in FIGS. 1 and 2, row lines 230 are coupled to emitter electrodes 60, and column lines 250 are coupled to gate electrodes 50. Thus, in this embodiment, the row driving voltage is negative in polarity. In other embodiments, row lines may be coupled to gate electrodes and column lines may be coupled to emitter electrodes. In those embodiments, the row driving voltage would be positive in polarity.

In the embodiment illustrated in FIG. 3, an enable signal is also supplied to each row driver 220*a*–220*c* in parallel over enable line 216. In the present embodiment, when the enable line 216 is low, all row drivers 220*a*–220*c* of FED screen 200 are disabled or switched to their off potential and no row is energized. When the enable line 216 is high, the row drivers 220*a*–220*c* are enabled.

In the particular embodiment of FIG. 3, a clock signal is also supplied to each row driver 220*a*–220*c* in parallel over clock line 214. The clock signal or horizontal synchronization signal (or HSYNC) pulses upon each time a new row is to be energized. The n rows of a frame are energized, one at a time, to form a frame of data. Assuming an exemplary frame update rate of 60 Hz, all rows are updated once every 16.67 milliseconds. Assuming n rows per frame update, the HSYNC signal pulses once every 16.67/n milliseconds. In other words a new row is energized every 16.67/n milliseconds. If n is 400, the HSYNC signal pulses once every 41.67 microseconds.

All row drivers of FED 200 are configured to implement one large serial shift register having n bits of storage, one bit per row. Row data is shifted through these row drivers using a row data line 212 that is coupled to the row drivers 220*a*–220*c* in serial fashion. During sequential frame update mode, all but one of the bits of the n bits within the row drivers contain a "0" and the other one contains a "1". Therefore, the "1" is shifted serially through all n rows, one at a time, from the upper most row to the bottom most row. Upon a given HSYNC signal pulse, the row corresponding to the "1" is then driven for the on-time window. The bits of the shift registers are shifted through the row drivers 220*a*–220*c* once every pulse of the HSYNC as provided by line 214. In interlace mode, the odd rows are updated in series followed by the even rows. A different bit pattern and clocking scheme is therefore used.

The row corresponding to the shifted "1" becomes driven responsive to the HSYNC pulse over line 214. The row remains on during a particular "on-time" window. During this on-time window, the corresponding row is driven with a row-on voltage. In one embodiment, the row-on voltage is the same as the voltage over voltage supply line 212 if the row drivers are enabled. The rows corresponding to the "0" remain "off," and these rows are driven with a row-off voltage.

As shown by FIG. 3, there are three columns per pixel within the FED flat panel display 200 of the present invention. Column lines 250*a* control one column of pixels, column lines 250*b* control another column line of pixels, etc. FIG. 3 also illustrates the column drivers 240 that control the gray-scale information for each pixel. The column drivers 240 drive amplitude modulated voltage signals over the column lines. In an analogous fashion to the row driver circuits, the column drivers 240 can be broken into separate circuits that each drive groups of column lines. The amplitude modulated voltage signals driven over the column lines 250*a*–250*e* represent gray-scale data for a respective row of pixels. Once every pulse of the HSYNC signal at line 214, the column drivers 240 receive gray-scale data to independently control all of the column lines 250*a*–250*e* of a pixel row of the FED flat panel display screen 200. Therefore, while only one row is energized per HSYNC, all columns 250*a*–250*e* are energized during the on-time window. The HSYNC signal over line 214 synchronizes the loading of a pixel row of gray-scale data (over column data line 205) into the column drivers 240. In an alternate embodiment of the present invention, the column drivers are placed at the top and bottom of the display 200.

Different voltages corresponding to the gray-scale data are then applied to the column lines by the column drivers 240 to realize different gray-scale colors. This is then repeated for another row, etc., once per pulse of the HSYNC signal of line 214, until the entire frame is filled. To increase speed, while one row is being energized, the gray-scale data for the next pixel row is simultaneously loaded into the column drivers 240. Like the row drivers, 220*a*–220*c* the column drivers assert their voltages within the on-time window. Further, like the row drivers 220*a*–220*c*, the column drivers 240 have an enable line (not shown).

Significantly, column drivers 240 receive a column bias voltage $V_{CB}$ via line 207. According to one embodiment of the present invention, the amplitude of $V_{CB}$ varies according to the row position of the currently activated row line. Because the voltages applied by the column drivers 240 are proportional to the column bias voltage $V_{CB}$, variations in the column bias voltage $V_{CB}$ will cause variations in the voltages driven over column lines 250. For example, in the present embodiment, $V_{CB}$ is lower when row line 2301 is "on" and relatively higher when row line 2309 is "on." Thus, for the same gray-scale data, the voltages driven over column lines 250 are lower when row line 2301 is "on" and are relatively higher when row line 2309 is "on." In accordance with the present invention, as voltage signals deteriorate along the column lines 250 due to transmission line effects, pixels on the row line 2301 and pixels on the row line 2309 will have the same brightness for the same gray-scale data. In this manner, the present invention provides effective compensation against variations in brightness caused by column trace-induced signal deterioration.

Figure 4:
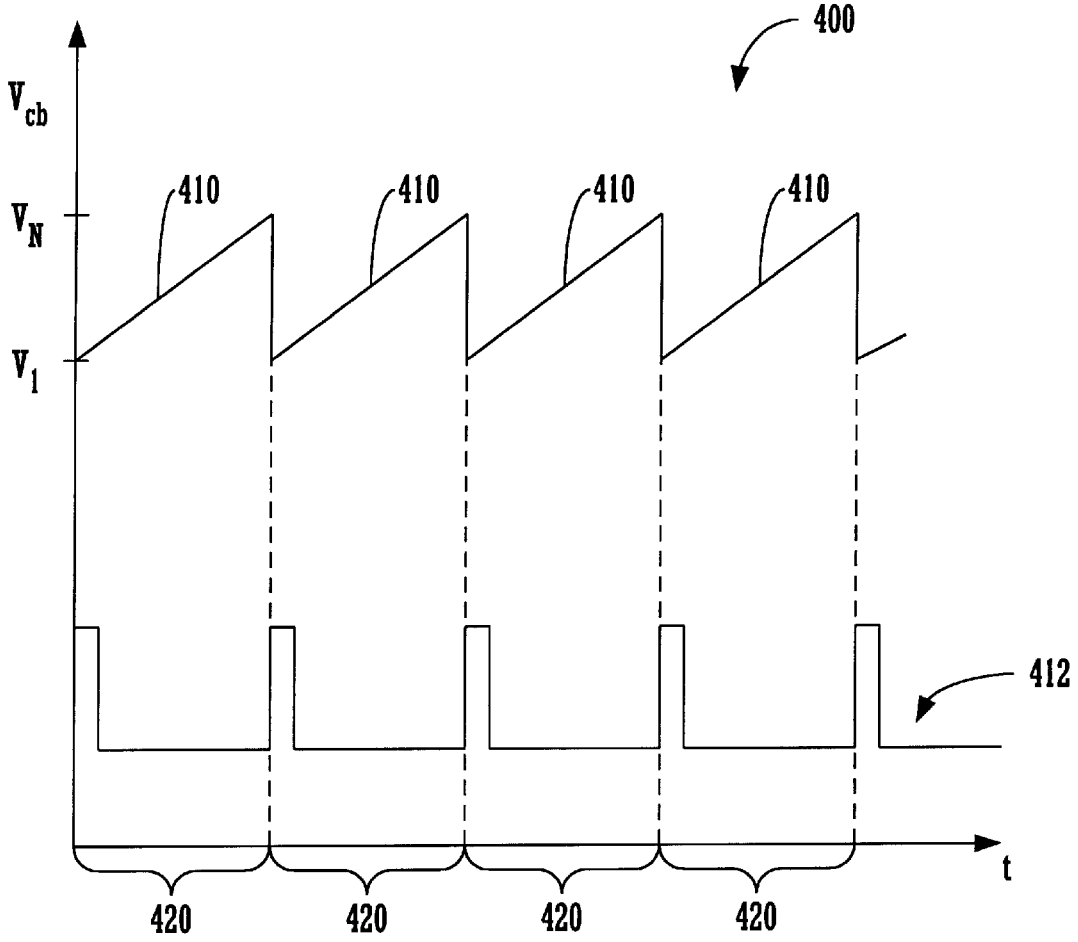
FIG. 4 illustrates the waveform of the column bias voltage $V_{CB}$ according to one embodiment of the present invention.

FIG. 4 illustrates a waveform 400 of the column bias voltage $V_{CB}$ according to one embodiment of the present invention. As illustrated, $V_{CB}$ is a periodic waveform synchronous with the vertical synchronization signal (VSYNC) of the display 200. Four exemplary VSYNC pulses 412 are also illustrated in FIG. 4. Waveform 400 further includes a voltage ramp 410 for every frame or field (assuming interlaced display format) 420. In the present embodiment, at the beginning of each frame 420, $V_{CB}$ is at an initial level $V_1$ and is applied to the column drivers 240 when the first row line (e.g., row line 2301) is "on." As the next row lines are subsequently turned on and off, $V_{CB}$ is increased to compensate for the signal loss along the column lines 250. $V_{CB}$ eventually ramps up to $V_N$ at the end of the frame 420 when the nth row line is "on." $V_{CB}$ then drops back to $V_1$ at the beginning of the next frame or field. The voltage pattern is then repeated for each frame 420.

Although waveform 400 is applicable to sequential-scan FEDs, it should be appreciated that the present invention is equally applicable to FEDs using other non-sequential addressing schemes. For those non-sequential addressing schemes, the waveforms of the column bias voltage would be shaped differently. However, those specific waveforms are not described herein to avoid obscuring aspects of the present invention.

Figure 5A:
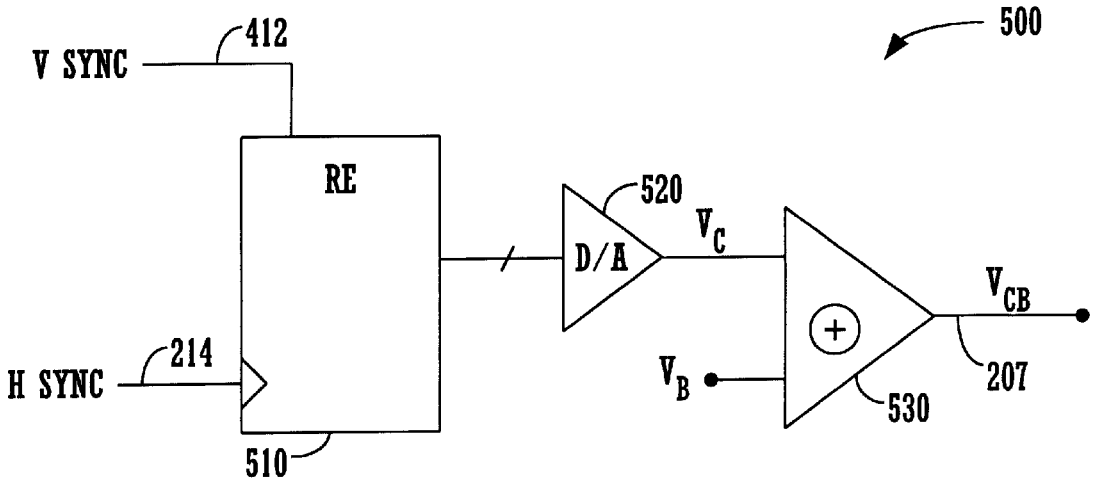
FIG. 5A is a logical block diagram illustrating a ramp generator circuit for generating the waveform of FIG. 4 according to one embodiment of the present invention.

FIG. 5A is a logical block diagram illustrating a ramp generator circuit 500 for generating the waveform 400 according to one embodiment of the present invention. As illustrated, ramp generator circuit 500 includes a counter circuit 510, a digital-to-analog (D/A) converter circuit 520 and a voltage adder 530. Counter circuit 510 is coupled to be clocked by the HSYNC (horizontal synchronization) signal 214 and is configured for generating an output representing the row number of the row line that is "on." In addition, a reset input (RE) the counter circuit 510 is coupled to the VSYNC (vertical synchronization) signal 412 that is asserted momentarily at the beginning of each frame or field. The output generated by the counter circuit 510 is then converted into a compensation voltage $V_C$ by the D/A converter circuit 520. As the row number is incrementing at each HSYNC pulse, $V_C$ is slowly increased. The compensation voltage $V_C$ is then added to a constant bias voltage $V_B$ to generate waveform 400 of FIG. 4.

Figure 5B:
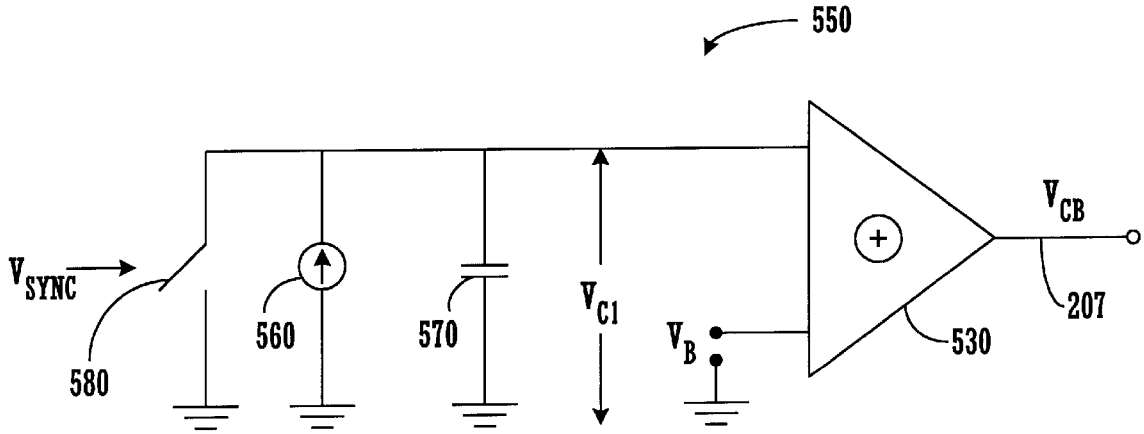
FIG. 5B is a logical block diagram illustrating another ramp generator circuit for generating the waveform of FIG. 4 according to another embodiment of the present invention.

FIG. 5B is a logical block diagram illustrating a ramp generator circuit 550 for generating the waveform 400 according to another embodiment of the present invention. As illustrated, ramp generator 550 includes a voltage adder 530, a current source 560, a capacitor 570 and a switch 580 operable by the VSYNC signal 412. During operation of the display, current source 560 charges capacitor 580 to generate a compensating voltage $V_{C1}$. At the end of each frame, VSYNC is asserted to close the switch 580 and discharges the capacitor 570. $V_{C1}$ is added to the constant bias voltage $V_B$ to generate the waveform 400.

It should be appreciated that ramp generator circuits 500 and 550 are illustrated for exemplary purposes only, and that it is possible to implement a circuit for generating waveform 400 in accordance with the present invention in many different and well known forms.

One advantage of the embodiments described above is that, by varying the column bias voltage $V_{CB}$, the gray-scale data (or color data) 205 of the display 200 is not altered. Consequently, gray-scale resolution of the display 200 is not compromised.

In another embodiment of the present invention, rather than varying the column bias voltage, the gray-scale data provided to the column drivers can be modified according to the row position of the currently activated row line. In that embodiment, data representative of the currently activated row line may be added to the gray-scale data. For example, a small value can be added to the gray-scale data when row line 2301 is active, and a relatively larger value can be added to the gray-scale data when row line 2309 is active to compensate for signal loss along the column lines 250. The resultant effect is that a display with uniform brightness is achieved. However, the gray-scale resolution of the display may be slightly affected.

Figure 6:
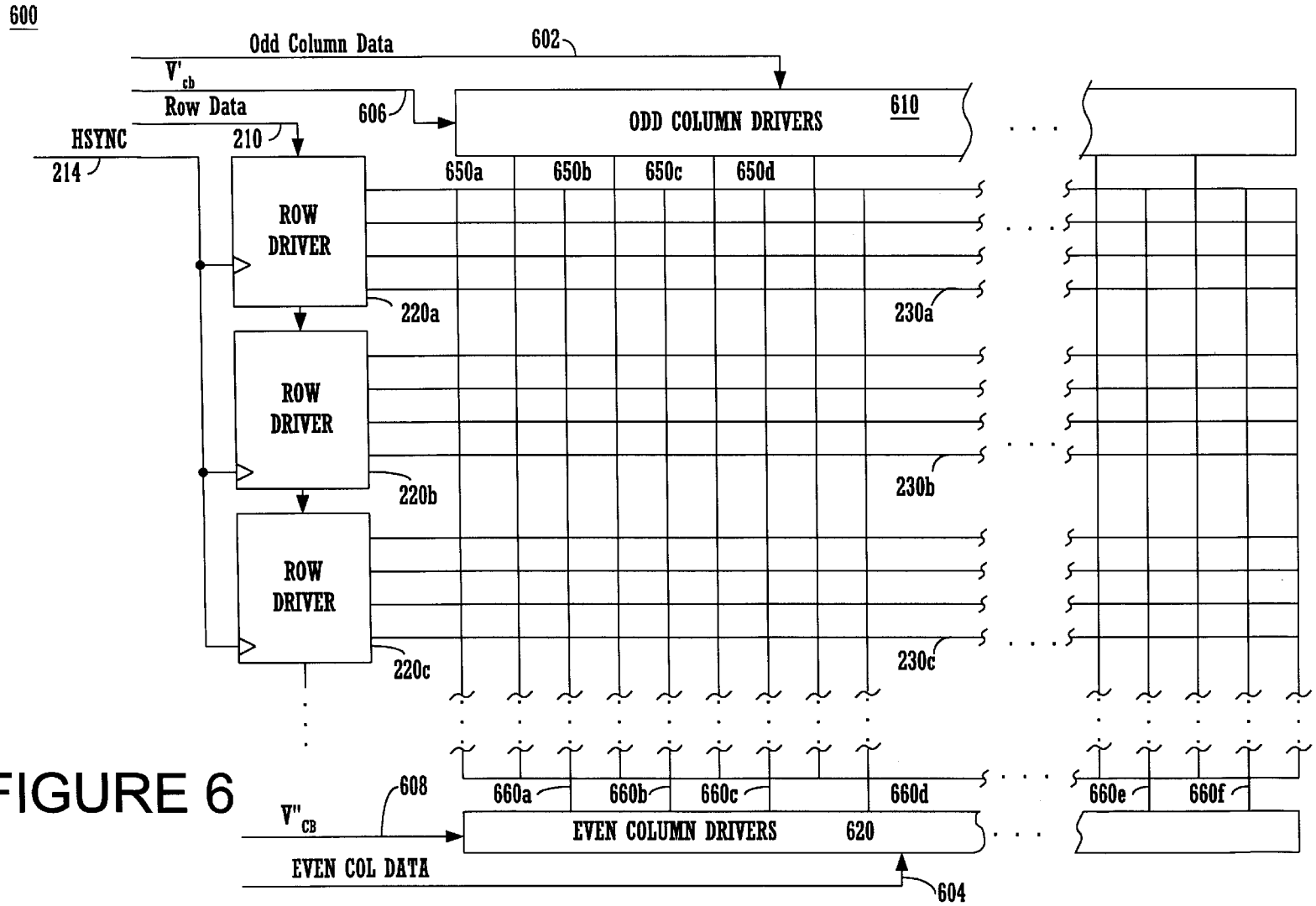
FIG. 6 is a plan view of an interdigitated FED screen according to one embodiment of the present invention.

FIG. 6 is a plan view of an interdigitated FED screen 600 according to one embodiment of the present invention. As illustrated, the interdigitated FED 600 screen consists of n row lines (horizontal) and x column lines (vertical). FED 600 operates in a similar fashion as FED 200. Row lines 230*a*–230*c* are driven by row driver circuits 220*a*–220*c* one row at a time. FED 600, however, includes odd column groups 650*a*–650*f* and even column groups 660*a*–660*f* each having three column lines (red, green, blue). Odd column groups 650*a*–650*f* and even column groups 660*a*–660*f* are interleaved with each other. FED 600 further includes odd column drivers 610 and even column drivers 620 for driving odd column groups 650*a*–650*f* and even column groups 660*a*–660*f*, respectively. Further, it should be noted that odd column groups 650*a*–650*f* are driven from the top end of the display 600 and that even column groups are driven from the bottom end (or vice-versa). In this configuration, without properly compensating for signal degradation along the column lines, a "comb-like" pattern will appear at the top and bottom regions of the screen. Also illustrated in FIG. 6 are line 602 for providing odd column drivers 610 with odd column gray-scale data and line 604 for providing even column drivers 620 with even column gray-scale data.

According to the present embodiment, odd column drivers 610 receive, via line 606, an odd column bias voltage $V'_{CB}$ which varies according to the row position of the currently active row line. Even column drivers 620 receive, via line 608, an even column bias voltage $V''_{CB}$ which also varies according to the row position of the currently active row line. $V'_{CB}$ and $V''_{CB}$, however, do not have the same waveform. Rather, in one embodiment of the present invention, $V'_{CB}$ and $V''_{CB}$ are complementary of each other because rows are activated in one direction commencing at one display edge and traversing toward the other display edge.

Figure 7A:
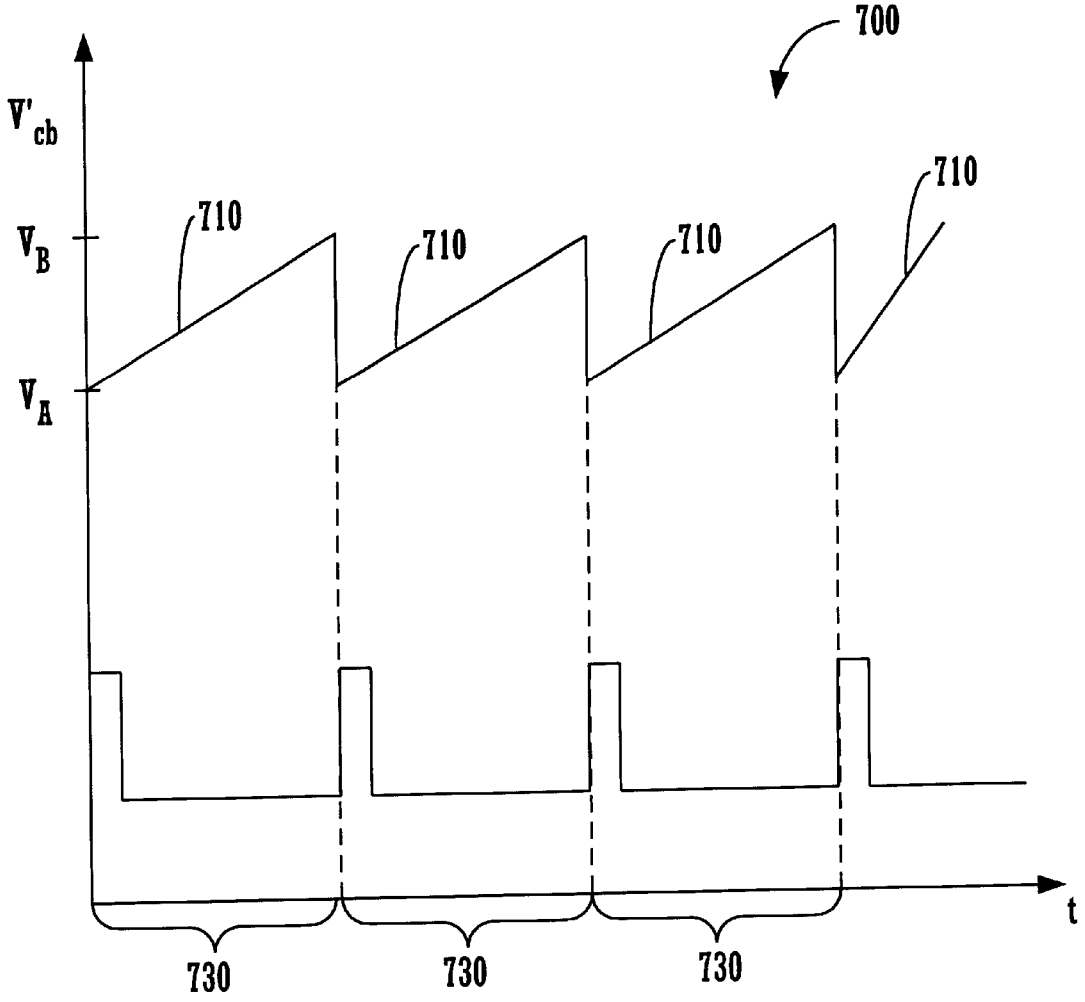
FIG. 7A illustrates the waveform for column bias voltage $V'_{CB}$ in accordance with one embodiment of the present invention.
Figure 7B:
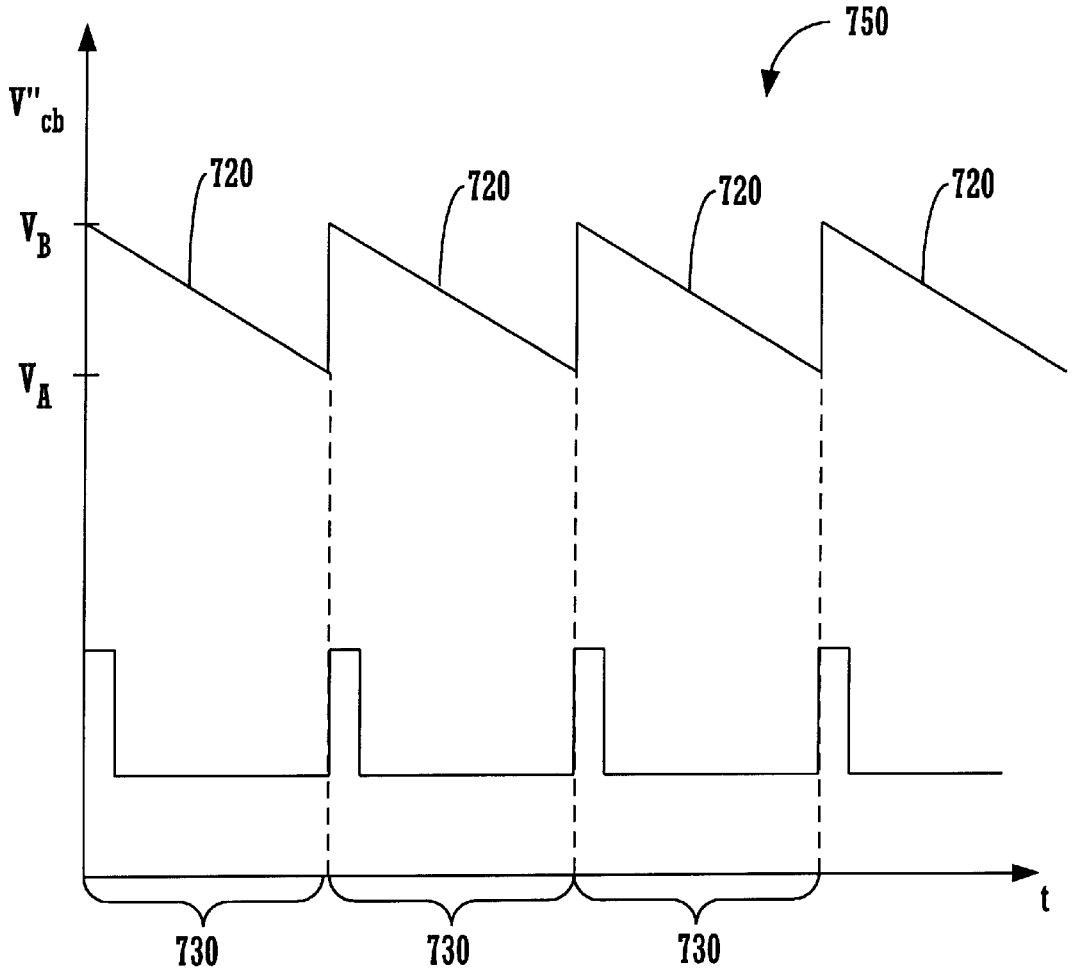
FIG. 7B illustrates the waveform for column bias voltage $V''_{CB}$ in accordance with one embodiment of the present invention.

FIG. 7A and FIG. 7B illustrate waveforms 700 and 750 for $V'_{CB}$ and $V''_{CB}$ in accordance with one embodiment of the present invention. As illustrated, $V'_{CB}$ and $V''_{CB}$ are periodic waveforms synchronous with the VSYNC signal 412 of the display 600. Waveform 700 includes positively-sloped voltage ramps 710 and waveform 750 includes negatively-sloped voltage ramps 720. In the present embodiment, at the beginning of each frame 730, $V'_{CB}$ is at an initial level $V_A$ when the first row line (e.g., row line 2301) is "on." As the next row lines are subsequently turned on and off, $V'_{CB}$ is increased to compensate for the signal loss along the column lines 250. $V'_{CB}$ eventually ramps up to $V_B$ at the end of the frame or field (assuming interlaced mode) 730 when the last row line is active. $V'_{CB}$ then drops back to $V_A$ at the beginning of the next frame or field. $V''_{CB}$, in contrast, is at an initial level $V_B$ when the first row line is active and gradually decreases until it reaches $V_A$ at the end of the frame or field 730. $V''_{CB}$ then jumps back to $V_B$ at the beginning of the next frame. These voltage patterns are then repeated for each frame or field 730.

Although the illustrated waveforms 700 and 750 are applicable to sequential-scan FEDs, it should be appreciated that the present invention is equally applicable to FEDs using other non-sequential addressing schemes. In those addressing schemes, the waveforms of the column bias voltage would be shaped differently. However, those waveforms are not described herein to avoid obscuring aspects of the invention.

Figure 8:
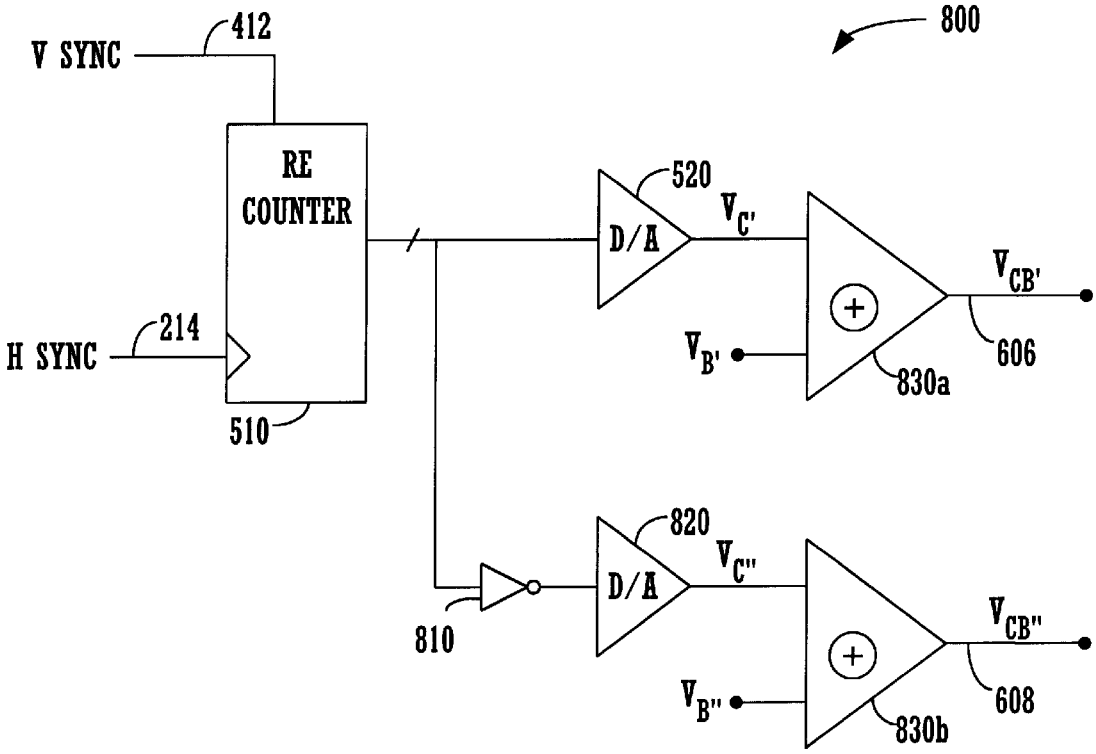
FIG. 8 is a logical block diagram illustrating a ramp generating circuit for generating $V'_{CB}$ and $V''_{CB}$ illustrated in FIGS. 7A and 7B according to one embodiment of the present invention.

FIG. 8 is a logical block diagram illustrating a ramp generating circuit 800 for generating $V'_{CB}$ and $V''_{CB}$ according to one embodiment of the present invention. As illustrated, ramp generator circuit 800 includes a counter circuit 510, digital-to-analog (D/A) converter circuits 520 and 820, inverters 810 and voltage adders 830*a*–830*b*. Counter circuit 510 is coupled to be clocked by the HSYNC (horizontal synchronization) signal 214 and is configured for generating an output representing the row number of the row line that is "on." In addition, the counter circuit 510 is coupled to be reset by the VSYNC (vertical synchronization) signal 412 that is asserted momentarily at the beginning of each frame. The output generated by the counter circuit 510 is the converted into a first compensation voltage $V'_C$ by the D/A converter circuit 520. The output generated by the counter circuit is also inverted by inverters 810 and the inverted signals are converted into a second compensation voltage $V''_C$ by the D/A converter circuit 820. The first compensation voltage $V'_C$ and the second compensation voltage $V''_C$ are then added to a constant bias voltage $V_B$ to generate waveforms 700 and 750, respectively.

It should be appreciated that ramp generator circuit 800 is illustrated for exemplary purposes only. It should be apparent to those skilled in the art, upon reading the present disclosure, that it is possible to implement a circuit for generating waveforms 700 and 750 in accordance with the present invention in many different forms.

Figure 9:
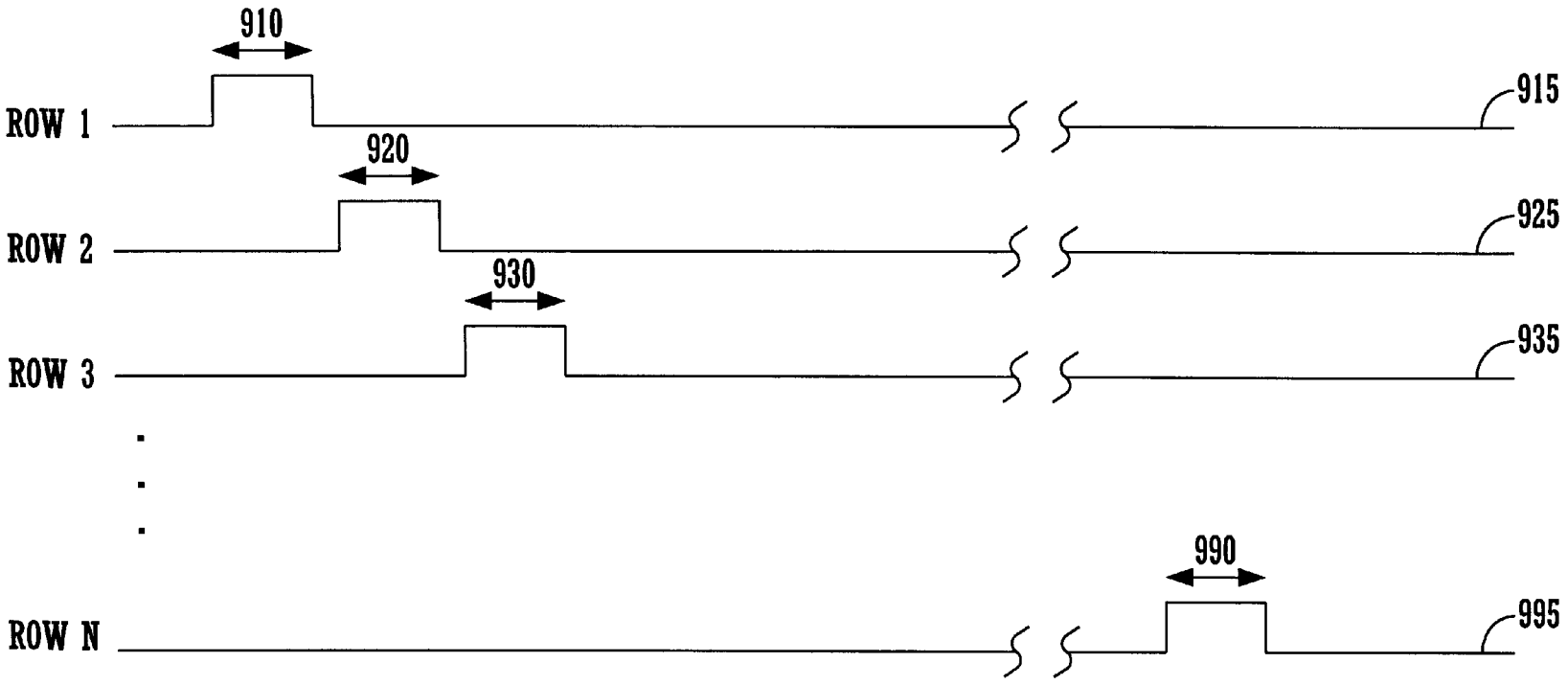
FIG. 9 illustrates timing diagrams of the row voltages within a single frame in accordance with the another embodiment of the present invention.

FIG. 9 illustrates timing diagrams of the row voltages within a single frame in accordance with the present embodiment. According to yet another embodiment of the present invention, signal deterioration can be compensated by modulating the "row-on time" according to the row position of the currently active row. Signals 915, 925 and 935 illustrate the voltages applied to the first three row lines (Row 1, Row 2 and Row 3) of a field emission display. Signal 995 illustrate the voltage applied to the nth row line (Row N) of the display. As illustrated, Row 1 is activated when signal 915 is asserted during row-on time 910. Row 2 is activated when signal 925 is asserted during row-on time 920. Row 3 is activated when signal 935 is asserted during row-on time 930. Row N is activated when signal 995 is asserted during row-on time 990.

Significantly, according to the present embodiment, the duration of the row-on times 910, 920, 930 and 990 are variable and are derived from the row position of the currently active row. In the illustrated embodiment, the farther the row is from the top edge of the display screen, the longer the row-on time. For example, Rows 1, 2 and 3 are close to the top end of the display and Row N is farther away than Rows 1, 2 and 3. Thus, row-on duration for Row N is longer than those of Rows 1, 2 and 3. In this way, uniform brightness across the display screen can be achieved. This approach may be used in combination with the column bias voltage modulation approach described above. Alternatively, this approach may be used by itself without varying the column bias voltage.

The present invention, a FED with uniform brightness independent of column trace-caused signal deterioration, has thus been disclosed. It should be appreciated that, while the present invention has been described in particular embodiments, the present invention should not be construed as limited by such embodiments, but rather construed according to the below claims.

What is claimed is:

1. A field emission display comprising:

a plurality of row lines, a plurality of column lines, and a plurality of electron-emissive elements disposed at intersections of said plurality of row lines and column lines;

a plurality of row drivers coupled to selectively activate said plurality of row lines one row at a time; and a plurality of column drivers coupled to drive column voltages over said plurality of column lines wherein said column voltages are derived from gray-scale data and a compensating voltage signal representative of a row position of a currently activated row line and wherein said compensating voltage signal compensates for transmission line effects of said plurality of column lines.

2. A field emission display as recited in claim 1 further comprising:

a controller circuit for generating said gray-scale data; and a compensation circuit for providing said compensating voltage signal.

3. A field emission display as recited in claim 2 wherein said compensation circuit comprises:

a counter circuit for generating row number data representative of said row position of said currently activated row line; and digital-to-analog converter for converting said row number data into said compensating voltage signal.

4. A field emission display as recited in claim 3 wherein said counter circuit is coupled to receive a horizontal synchronization signal and is configured to be reset by a vertical synchronization signal.

5. A field emission display as recited in claim 2 wherein said compensation circuit comprises:

a current source for generating a bias current;

a capacitor coupled to said current source for providing said compensating voltage by integrating said bias current to provide said compensation voltage; and a transistor responsive to a vertical synchronization signal for periodically discharging said capacitor.

6. A field emission display as recited in claim 1 wherein said compensating voltage signal is a periodic waveform having a linear ramp based on said row position and further having a period synchronized to a vertical synchronization signal of said field emission display.

7. A field emission display comprising:

a plurality of row lines, a plurality of column lines, and a plurality of electron-emissive elements disposed at intersections of said plurality of row lines and column lines;

a plurality of row drivers coupled to selectively activate said plurality of row lines one row at a time; and a first group of column drivers coupled to a first group of said plurality of column lines for driving first column voltages over said first group of column lines wherein said first column voltages are derived from gray-scale data and a first compensating voltage representative of a row position of a currently activated row line and wherein said first compensating voltage signal compensates for transmission line effects of said first group of column lines.

8. A field emission display as recited in claim 7 further comprising a second group of column drivers coupled to a second group of said plurality of column lines for driving second column voltages over said second group of said column lines wherein said second column voltages are derived from gray-scale data and a second compensating voltage representative of said row position of said currently activated row line and wherein said second compensating voltage signal compensates for transmission line effects of said second group of column lines.

9. A field emission display as recited in claim 8 wherein said first group of column drivers are positioned along a top region of said field emission display and wherein said second group of column drivers are positioned along a bottom region of said field emission display.

10. A field emission display as recited in claim 8 further comprising:

a controller circuit for generating gray-scale data; and a compensation circuit for providing said first compensating voltage signal and said second compensating voltage.

11. A field emission display as recited in claim 10 wherein said compensation circuit comprises:

a counter circuit coupled to receive a horizontal synchronization signal for generating row number data representative of said row position and configured to be reset by a vertical synchronization signal;

a first digital-to-analog converter for converting said row number data into said first compensating voltage signal; and a second digital-to-analog converter for converting said row number data into said second compensating voltage signal.

12. A field emission display as recited in claim 8 wherein said first compensating voltage signal comprises a first periodic waveform having a first ramp with a positive slope, and wherein said second compensating voltage signal comprises a second periodic waveform having a second ramp with a negative slope.

13. A field emission display as recited in claim 12 wherein said first periodic waveform and said second periodic waveform each has a period synchronized to a vertical synchronization signal of said field emission display.

14. An electronic system for controlling a plurality of row lines and a plurality of column lines of a field emission display, said system comprising:

a plurality of row drivers coupled to selectively activate said plurality of row lines one row at a time;

a first compensating voltage circuit configured for providing a first compensating voltage representative of a row position of a currently activated row line; and a first group of column drivers coupled to drive first column voltages over a first group of said plurality of column lines, wherein said first column voltages are derived from gray-scale data and said first compensating voltage, and wherein said first compensating voltage compensates for transmission line effects of said first group of column lines.

15. An electronic system as recited in claim 14 wherein said first compensation circuit comprises:

a counter circuit coupled to receive a horizontal synchronization signal for generating row number data representative of said currently activated row; and a first digital-to-analog converter for converting said row number data into said first compensating voltage signal.

16. An electronic system as recited in claim 14 further comprising:

a second compensating voltage circuit configured for providing a second compensating voltage representative of said row position of said currently activated row line; and a second group of column drivers coupled to drive second column voltages over a second group of said plurality of column lines wherein said second column voltages are derived from gray-scale data and said second compensating voltage, and wherein said second compensating voltage signal compensates for transmission line effects of said second group of column lines.

17. An electronic system as recited in claim 16 wherein said second compensation circuit comprises:

a counter circuit coupled to receive a horizontal synchronization signal for generating row number data representative of said currently activated row;

an inverter for inverting said row number data to generate inverted row number data; and a second digital-to-analog converter for converting said inverted row number data into said second compensating voltage signal.

18. An electronic system as recited in claim 16 wherein said first group of column drivers are positioned along a top region of said field emission display and wherein said second group of column drivers are positioned along a bottom region of said field emission display.

19. An electronic system as recited in claim 18 wherein said first compensating voltage signal is a first periodic waveform having a first ramp with a positive slope, wherein said second compensating voltage signal is a second periodic waveform having a second ramp with a negative slope, and wherein wherein said first periodic waveform and said second periodic waveform are synchronized to a vertical synchronization signal of said field emission display.

20. A field emission display comprising:

a plurality of row lines, a plurality of column lines, and a plurality of electron-emissive elements disposed at intersections of said plurality of row lines and column lines;

a plurality of column drivers coupled to first ends of said plurality of column lines, said plurality of column drivers configured for driving column voltages over said plurality of column lines; and a plurality of row drivers coupled to selectively activate said plurality of row lines one row at a time wherein a row-on time of a currently activated row line varies according to a row position of said currently activated row line.

21. A field emission display as recited in claim 20 wherein said plurality of row lines comprises:

a first row line positioned closely to said first ends of said column lines; and a second row line positioned farther from said first ends of said column lines than said first row line wherein row-on time of said second row line is longer than row-on time of said first row line.

22. A field emission display comprising:

a plurality of row lines, a plurality of column lines, and a plurality of electron-emissive elements disposed at intersections of said plurality of row lines and column lines;

a plurality of row drivers coupled to selectively activate said plurality of row lines one row at a time; and a plurality of column drivers coupled to drive column voltages over said plurality of column lines wherein said column voltages are derived from gray-scale data and wherein said gray-scale data is modified according to a row position of a currently activated row line.

* * * * *